United States Patent [19]

Oshima et al.

[11] Patent Number: 4,915,715

[45] Date of Patent: Apr. 10, 1990

[54] HUMIDITY CONDITIONER

[75] Inventors: Masayuki Oshima, Tamano; Akira Matsuoka, Okayama; Kazuhiko Asano, Okayama; Kiyoshi Mimura, Okayama; Masanori Shimada, Yahata; Hajime Baba, Nara; Hiroshi Okamoto, Okayama, all of Japan

[73] Assignee: Daiken Kogyo Kabushiki Kaisha, Toyama, Japan

[21] Appl. No.: 328,922

[22] Filed: Mar. 27, 1989

[30] Foreign Application Priority Data

Mar. 29, 1988 [JP] Japan ..... 63-75781
Jul. 20, 1988 [JP] Japan ..... 63-180735
Jan. 25, 1989 [JP] Japan ..... 1-15884

[51] Int. Cl.[4] ..... B01D 19/00

[52] U.S. Cl. ..... 55/208; 55/163; 55/388

[58] Field of Search ..... 55/387, 163, 388, 208

[56] References Cited

U.S. PATENT DOCUMENTS 2,595,306 5/1952 Seaman ..... 55/208

FOREIGN PATENT DOCUMENTS 10556 4/1975 Japan ..... 55/388

*Primary Examiner*—Bernard Nozick
*Attorney, Agent, or Firm*—Edwin E. Greigg

[57] ABSTRACT

A humidity conditioner comprising a moisture absorber and a heating element attached to or embedded in the moisture absorber. The moisture absorber includes a porous material having continuous fine interstices, and a hygroscopic filler filling the interstices.

13 Claims, 4 Drawing Sheets

HUMIDITY CONDITIONER

BACKGROUND OF THE INVENTION (1) Field of the Invention

The present invention relates to a humidity conditioner for humidity-conditioning a room by dehumidifying the room at a time of high humidity by absorbing moisture therefrom and condensing the moisture for passage through a moisture absorber and discharge outwardly of the room, and releasing moisture from the moisture absorber to the room at a dry time, and to a novel humidity-conditioning apparatus for a storeroom which utilizes the above humidity conditioner for humidity-conditioning the storeroom while effecting mildew-proofing and preventing dew drop formation.

(2) Description of the Prior Art

An example of a known, commercially available dehumidifying is disclosed in Japanase Patent Publication Kokai No. 55-159827. This dehumidifier has a large-scale construction comprising a filter formed of a corrugated asbestos sheet or the like impregnated with a hydroscopic filler, the filter being exposed to hot air flows thereby to collect high-humidity air.

Although the above dehumidifier has an excellent dehumidifying capability, it is not suited for use in a closet or a storeroom since air must be recirculated and the mechanical noise is produced.

Dehumidifying agents are also commercially available but they cannot be regenerated and therefore require the trouble of periodic replacements.

Further, the above dehumidifier has the disadvantage that it is incapable of effecting humidity conditioning by humidifying a room when the room becomes excessively dry.

On the other hand, Japanese Patent Publication Kokai No. 60-103909 discloses a known example of storerooms having a dehumidifying function without using a rotational drive. This storeroom utilizes the Peltier effect but has the following disadvantages. The construction of this storeroom comprises peripheral walls and a door with a heat insulating treatment, and a thermoelectric cooler disposed at an upper position for dehumidifying the storeroom by utilizing the Peltier effect. Air is cooled through contact with a cooling member, thereby to form dew drops which flow down to be collected and discharged outwardly of the storeroom. Only a minor dehumidifying effect is produced during wintertime since there is a small difference between air temperature and cooling member temperature and since dew drops are formed on the cooling member. Consequently, dew drops are formed on the wall of the storeroom facing north. During summer, on the other hand, the storeroom produces a dehumidifying effect while in operation, but the temperature in the storeroom will fall when the storeroom is cooled with the dehumidifying function stopped. As a result, the relative humidity will increase to produce moist atmosphere since moisture is trapped due to the moisture-insulating layers.

Thus, the known storeroom could result in mildew formation and dampen articles stored therein, as distinct from a known wooden storeroom whose side plates themselves have a humidity-conditioning function.

SUMMARY OF THE INVENTION

The present invention has been made having regard to the state of the art noted above. A primary object of the present invention is to provide a compact humidity conditioner having a simple construction and yet excellent moisture absorbing and desorbing capabilities, allowing regeneration of a hygroscopic filler, and continuously usable over a long period of time. The humidity conditioner condenses absorbed moisture within a panel for discharge through a back surface of a moisture absorber by a heating element disposed on the back surface thereof and, when the room is excessively dry, absorbs moisture from a water holder and releases the moisture through the moisture absorber to the room.

In order to achieve the above primary object, a dehumidifying apparatus according to the present invention comprises a moisture absorber including a porous material formed of laminated fiber and having continuous fine interstices, and a hygroscopic filler filling the interstices, the moisture absorber having at least one laminar section acting as a moisture absorbing face, and a heating element integrated with another face of the moisture absorber for allowing release of moisture from the moisture absorber.

A secondary object of the present invention is to provide a storeroom having a dehumidifying function without necessitating a drive therefor. The storeroom has proper humidity conditioning function even when at rest regardless of seasons and without being influenced by cooling and heating of its interior space.

In order to achieve the secondary object, a storeroom according to the present invention comprises a humidity-insulated box defining a moisture absorbing opening in part of four peripheral sides thereof, a moisture absorber including a porous material formed of laminated fiber and having continuous fine interstices, and a hygroscopic filler filling the interstices, the porous material having laminar surface acting as a moisture absorbing face opposed to the moisture absorbing opening, a heating element integrated with another laminar surface acting as a moisture desorbing face of the moisture absorber, and a moisture release opening defined in a peripheral position of the box for communicating with the moisture desorbing face of the moisture absorber.

How the present invention functions will now be described. Moisture absorbed by the moisture absorber tends to move to a position in the moisture absorber having a low moisture content gradient and a low steam pressure gradient. At this time, the presence of the hygroscropic filler in the interstices enables a moisture absorption twice to several tens of times the moisture absorption without the hygroscropic filler, and promotes the moisture movement even with very small differences in the moisture content and steam pressure. The moisture movement has a directional characteristic since, in the porous material formed of laminated fiber, the fiber has a two-dimensional expanse chiefly parallel to the laminates. Consequently, when the front face of the moisture absorber is exposed to a highly humid room, the moisture absorbed moves along the laminates to spread throughout the moisture absorber. At this time, the heating element provided on the other face opposite the moisture absorbing face is operated, whereby the moisture adjacent the heating element is released in water vapor from the other face. As a result, the moisture content adjacent the heating element is decreased, thereby regenerating the hygroscopic filler adjacent the heating element. The moisture released from the back surface of the moisture absorber through heating forms dew drops on the cover member to be collected in the water holder below. Conversely, at a time of low humidity in the room to which the front face of the moisture absorber is exposed, the water in the water holder is evaporated to be absorbed by the moisture absorber. The absorbed moisture is caused by the steam pressure gradient to move toward the front face and to be released from the front face to the room. As a result, the humidity in the room is maintained within a certain range.

How the storeroom utilizing the above humidity conditioner functions will be described next. When the storeroom is highly humid, moisture absorbed therefrom spreads throughout the moisture absorber. Thereafter the heating element provided on a laminar face (acting as the moisture desorbing face) of the moisture absorber outside the storeroom is operated for a predetermined time, whereby the moisture adjacent the heating element is released in water vapor outwardly of the storeroom. As a result, the moisture content adjacent the heating element is decreased, thereby regenerating the hygroscopic filler adjacent the heating element.

In order to effectively use the above moisture absorber without necessitating a large space therefor, the storeroom defines a moisture absorbing opening in part of the four peripheral walls for attaching the moisture absorber. This construction secures a large moisture absorbing area. The storeroom performs the humidity-conditioning function even when at rest. Thus, there is no possibility of forming dew drops on the inside walls of the storeroom in winter, or humidifying the storeroom interior due to an increase in the relative humidity in the storeroom during a cooling operation in summer. The above humidity conditioning mechanism realizes an effective humidity conditioning not only during a dehumidifying operation but during a rest period, thereby forming no dew drops or mildew with environmental changes.

The advantages produced by the present invention are as follows:

In the present invention, the moisture absorber includes a porous material formed of laminated fiber and having continuous fine interstices, and a hygroscopic filler filling the interstices, the moisture absorber having at least one laminar section acting as a moisture absorbing face, and a heating element integrated with another face of the moisture absorber for allowing release of moisture from the moisture absorber. Moisture movement has a directional characteristic since, in the porous material formed of laminated fiber, the fiber has a two-dimensional expanse chiefly parallel to the laminates. Consequently, the moisture is readily allowed to move toward the face with which the heating element is integrated. This permits the moisture absorbing face and moisture desorbing face to be oriented in selected direction, thereby enabling effective dehumidification.

Thus, dehumidification and regeneration are possible without recirculation of air. This feature provides an advantage of low running cost with minimal energy application. The humidity conditioner according to the present invention has little influence on room temperature, and therefore is suited for dehumidifying a closet or a storeroom.

The moisture absorbed into the moisture absorber is released in water vapor from the heating face of the absorber by the action of the heating element. Thus, no outflow of the hygroscopic filler occurs, enabling a high moisture absorbing function to be maintained over a long period of time. This feature has a further advantage of avoiding fouling, damage and deterioration of peripheral equipment due to outflow of the hygroscopic filler.

In addition, the moisture absorber per se requires no air recirculating device or the like. This allows the peripheral equipment to be simplified and the installation to be compact. As a result, this humidity conditioner may be incorporated into an air-conditioner or a wall of a building to provide a dehumidifying method entirely different from conventional dehumidifying methods.

According to the present invention, the apparatus is operable in response to the relative humidity, such that the moisture absorber absorbs moisture when a room is highly humid, and releases the moisture to the room when the latter is excessively dry. Thus, the apparatus of the present invention can humidity-condition the room as distinct from the known dehumidifier. This apparatus, therefore, is effective for maintaining environment in a room such as a storeroom for fur, books or antiques.

The moisture in the storeroom is absorbed by the moisture absorber and is released outwardly through the moisture releasing opening defined in the box, thereby significantly reducing the humidity in the storeroom. The storeroom dehumidification is carried out very quietly since no drive is involved at this time. In addition, the use of the heating element for releasing moisture does not produce dew drops or frost on the desorbing face of the moisture absorber, as in the dehumidification utilizing the Peltier effect, when the room is heated in winter time. The storeroom is humidity-conditioned even when a dehumidifying operation is not taking place, and effective humidity conditioning is continuously provided for the storeroom through all seasons.

Other advantages of the present invention will be apparent from the following description of the preferred embodiments to be had with reference to the drawings.

BRIEF DESCRIPTION OF THE DRAWINGS

The drawings show humidity conditioners and storerooms having a humidity conditioning function according to the present invention, in which.

DETAILED DESCRIPTION OF THE PREFERRED EMBODIMENTS

The present invention as embodied will be described in detail hereinafter with reference to the drawings.

A moisture absorber 4a according to the present invention may be formed of a porous material having fine interstices, such as;

(1) rock fiber, glass fiber or other inorganic fiber bound together with a binder, or (2) nonwoven cloths or fiber plates as above laminated in an appropriate thickness.

Figure 5:
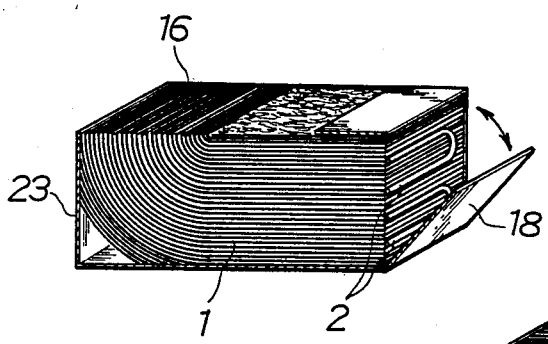
FIG. 5 is a schematic sectional view of a principal portion of the above embodiments.
Figure 6:
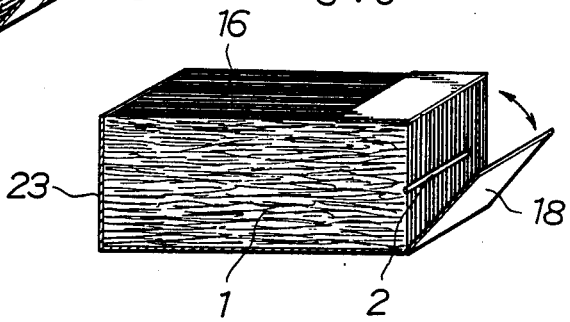
FIG. 6 is a schematic sectional view of a principal portion of a modified humidity conditioner.

As shown in FIG. 5, the laminated porous material may have one of opposite laminar face bent in a selected direction. Alternatively, as shown in FIG. 6, the material may have adjacent laminar faces acting as a moisture absorbing surface and a moisture desorbing surface for desorbing moisture in a right-angle direction.

The porous material should preferably have a moisture permeability not less than $1\times10^{-3}$ g/m·h·mmHg, and a resistance of heat conduction not less than 2.0 m·h·°C./kcal since the greater the temperature difference is between a front surface and a back surface when heated, moisture movement to the back surface is the more promoted. In order to promote capillary flows, and in order to retain a hygroscopic filler, which will be described later, the porous material should preferably have a good distribution of interstice sizes in the range of 0.1 to 100 micrometers. In the case of laminated porous material, an interstice size distribution of 1 micrometer and upward is well suited for moisture movement.

Further, the porous material needs to have a thickness of at least 5 mm, preferably 20 mm or more, since the thicker the material is, the greater is its moisture retention and the slower is the heat conduction to the front surface when the back surface is heated, thereby facilitating formation of a temperature gradient and a moisture holding gradient.

In the present invention, the hygroscopic filler comprises (1) a deliquescent material such as calcium chloride, lithium chloride or the like, (2) a water-soluble high polymer such as diethylene glycol, triethylene glycol, glyceline, sodium polyacrylate, PVA or the like, (3) an inorganic hygroscopic material such as bentonite, sepiolite, zeolite, activated alumina, zonotolite, activated carbon, molecular sieves or the like, and (4) a water-insoluble high polymer hygroscopic material such as graft starch, isobutylene maleic anhydride or the like, which are used alone or in combination.

The porous material is filled with the hygroscopic filler by a method in which the filler is applied together with the binder and fiber at the time of integrating these components, or a method in which, after the porous material is obtained, the porous material is made hydrophilic by means of a surface active agent or the like, impregnated with the hygroscopic filler dissolved in water, and dried.

A heater 2 used in the present invention comprises a metal wire, or an etched metal or a conductive coating material applied to a gas-permeable sheet, with a suitable moisture-proofing and short-circuit-proofing treatment. The heater may include a heat distributing sheet such as a metal netting laid thereon to uniformalize heat. The heating temperature may be set so that the material temperature becomes 60° to 140° C., although the higher the temperature is, the moisture desorption is the more promoted and the shorter becomes the moisture desorbing time. A moisture sealing door may be provided for preventing absorption of external moisture at a moisture absorbing time, which door is opened at a heating time. The heater may effectively be used to heat the moisture absorber for several hours after the absorber is allowed to absorb moisture for a predetermined time and becomes moist. This operation may be controlled by means of a timer or a temperature sensor.

(First Embodiment)

Figure 1:
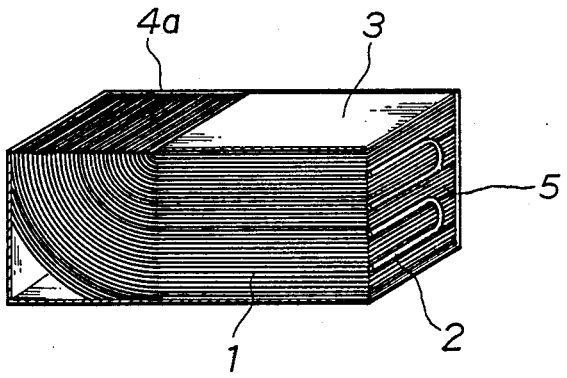
FIG. 1 is a sectional perspective view of a principal portion of a humidity conditioner.

FIG. 1 shows a first embodiment of the present invention, in which the moisture absorber 1 comprises the porous material formed by laminating fibers containing the hygroscopic filler. The moisture absorber 1 is bent in advance so that laminar faces are at right angles to each other. Number 2 indicates the heating wire, and number 3 indicates a cover member overlying the moisture absorber 1. The moisture absorber 1 is used as mounted on a wall or the like, with a moisture absorbing face 4a exposed to a room interior and a moisture desorbing face 5 connected to a duct or the like disposed on a back surface of the wall. Moisture absorbed by the moisture absorber 1 is guided by the moisture absorber 1 and cover member 3 and is released through the moisture desorbing face 5.

According to the above construction, a long distance is secured in a limited space between the moisture absorbing face and the moisture desorbing face. Thus, the heat generated by the heating wire 2 is not readily conducted to the moisture absorbing face, thereby preventing release of the moisture from the moisture absorbing face to the room interior. The duct extends outwardly of the system and is ventilated. Moisture is then absorbed through the moisture absorbing face, and is released through the moisture desorbing face and outwardly of the system.

Figure 2:
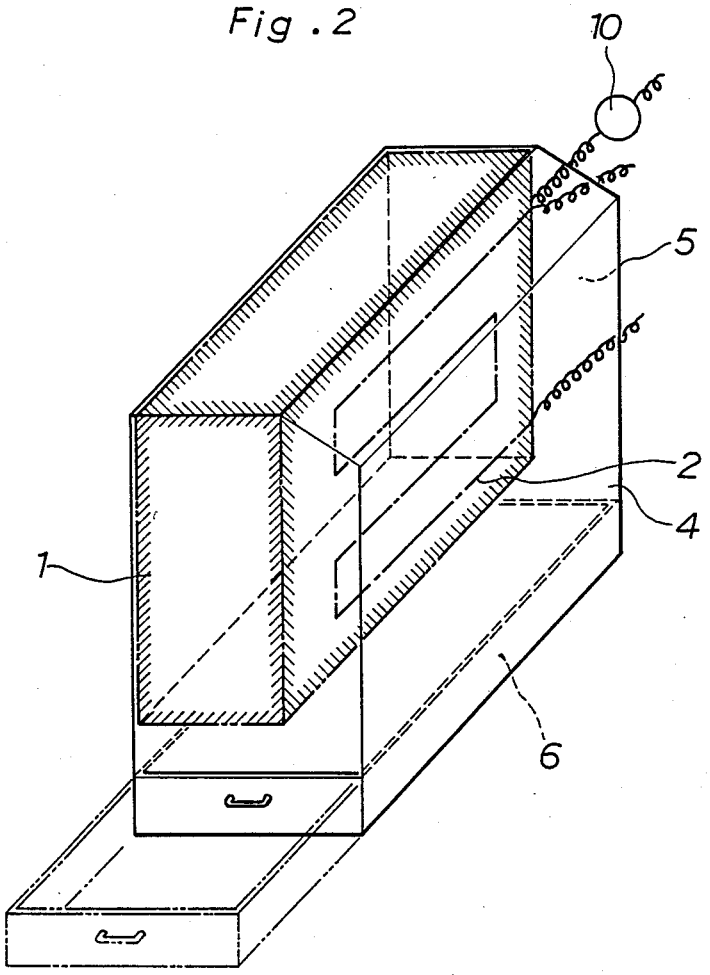
FIG. 2 is a schematic perspective view of a principal portion of the humidity conditioner.

Referring to FIG. 2, the cover member 4 according to the present invention comprises a plastic plate or a metal plate which is moisture imperpeable and waterproof, and has excellent heat conduction to readily form dew drops.

The moisture absorber 1 is mounted so that a spacing is formed between the cover member 4 and the back bottom of the moisture absorber 1. A water holding device 6 is placed below the cover member 4.

The water holding device 6 serves to hold dew drops flowing down inside the cover member 4. This water holding device 6 is removable, to throw away water accumulating therein and to replenish water at a humidifying time. Number 10 indicates a moisture content sensor.

Figure 3:
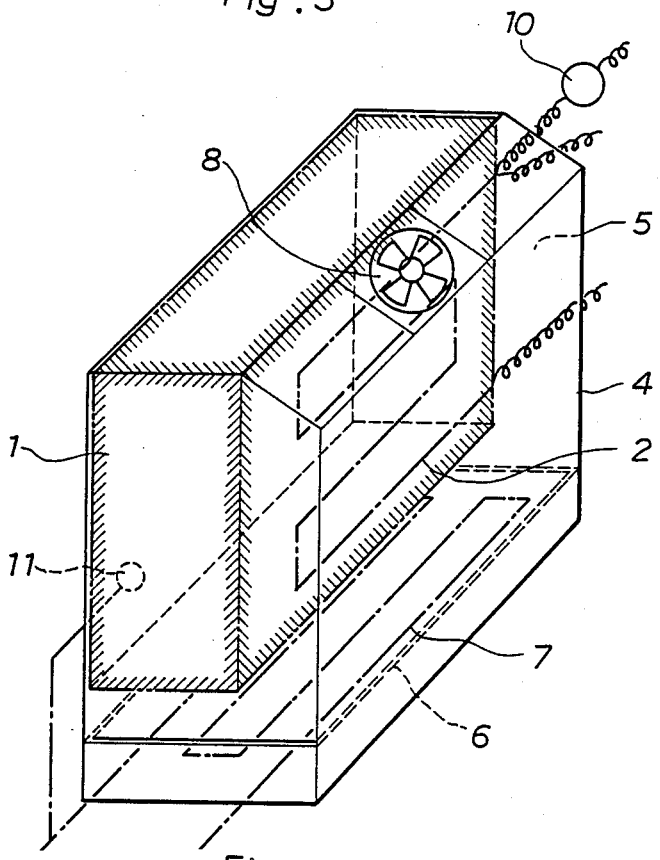
FIG. 3 is a schematic perspective view of another humidity conditioner.

As shown in FIG. 3, the water holding device 6 may include a heater 7 which is operable under a low humidity condition to promote evaporation of water in the cover member 4. As a result, the moisture absorber 1 becomes highly moist from the back surface, and release moisture from its front surface to the room interior, thereby quickly effecting moisture control of the room. Further, as shown in FIG. 3, a ventilating fan 8 may be attached to the cover member 4, which fan is selectively operable when the heater 7 is operated.

Thus, the moisture released from the back surface of the moisture absorber 1 may be released outwardly of the cover member 4 with the operation of the heater 9, whereby dehumidification is effected quickly.

Automatic running of the apparatus may be achieved by controlling, in an interlocked manner, the moisture content sensor 10 which detects equilibrium moisture content of the moisture absorber 1, the heating wire 2 of the moisture absorber 1, the heater 7 of the water holding device 6, and the fan 8 in response to a relative humidity of the room environment.

The control of these components may be effected by means of a humidity sensor 11 provided on the moisture absorber 1 opposed to the room interior. The heater 7 of the water holding device 6 is operated when the humidity in the room falls below a predetermined humidity.

Figure 4:
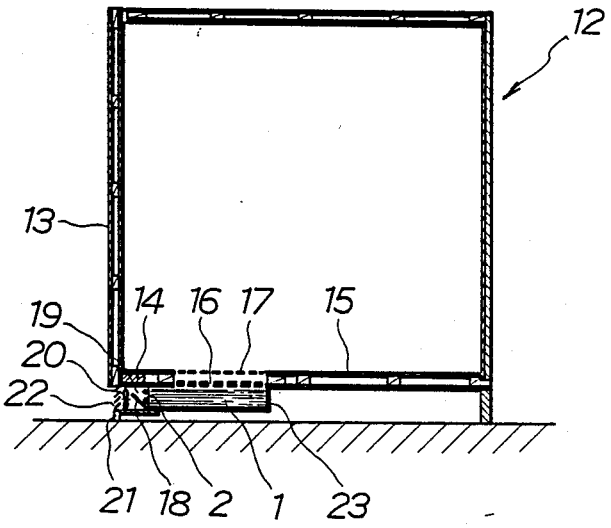
FIG. 4 is a schematic view in vertical section of a further humidity conditioner.

FIG. 4 shows a box 12 of high moisture insulation used in the present invention. This box 12 is formed of a plastic plate, a metal plate, a plywood board having moisture-insulating front and back surfaces with PVC sheets or polyester resin coatings applied thereto, or a flush panel including an adhesive such as vinyl acetate resin or the like having low moisture permeability applied over entire opposed surface of two plywood boards which are rigidly interconnected by crosspieces. A front door 13 is hinged for opening and closing a front opening of the box 12, and a packing 14 is disposed at a position of contact between the front door 13 and an edge of the box 12 defining the opening.

In the embodiment of FIG. 4, the box 12 includes a bottom plate 15 defining a moisture absorbing opening 16, and the moisture absorber 1 shown in FIG. 5 is mounted therein through a dust filter 17 to seal the interior of the box 12. The moisture absorber 1 is housed in a casing 23 including a moisture releasing door 18 at a front of the casing 23. The door 18 opens to expose the moisture desorbing face of the moisture absorber 1 at a heating time. A moisture releasing opening 19 is provided outside the moisture releasing door 18, and the box 12 includes a fan 20 for releasing moisture through a louver 22 at the front of a caster 21. The moisture absorber 1 includes a heater 2 on the moisture desorbing face.

Figure 7:
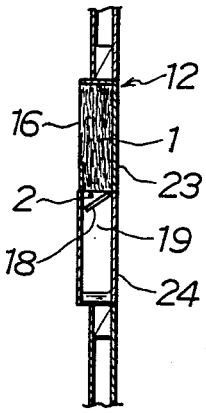
FIG. 7 is a view in vertical section of the above embodiment.
Figure 8:
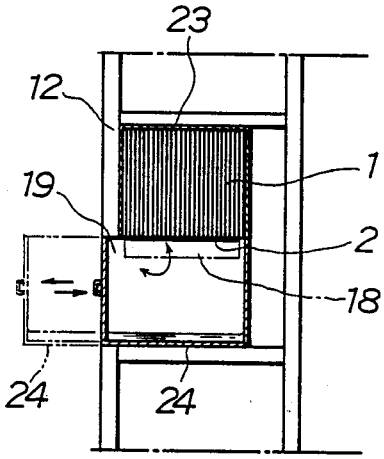
FIG. 8 is a section taken on line X—X of FIG. 7, and FIGS. 9 and 10 are graphs illustrating performance comparisons.

FIGS. 7 and 8 show another embodiment of the present invention for humidity conditioning a room. In this embodiment, the box 12 has a side plate defining a moisture releasing opening 16, the moisture absorber 1 has a heater 2 disposed on a bottom surface acting as the moisture desorbing face, and the moisture desorbed is collected in a removable water vessel 24 for disposal. In this embodiment too, a moisture releasing door 18 is hinged to open and close the moisture desorbing face.

An excellent moisture conditioning effect is produced where the moisture absorber 1 has an exposed surface area not less than 100 $cm^2$, preferably 500 to 2,000 $cm^2$, for 1 $m^3$ of the storeroom volume.

(Specific Construction of the Moisture Absorber −1)

A laminar moisture absorber 1 was prepared by impregnating a rock fiber board (specific gravity: 0.25, average interstice diameter: 55 micrometers, and void ratio: 90.6%) having phenol resin sized 200×150×50 mm as the binder, with 15% by weight of calcium chloride acting as the hygroscopic filler. Three of this moisture absorber 1 were stacked one upon another with one laminar face overlying another through 1.5 mm thick plastic plates acting as guides and reinforcements. The resulting product was placed in a cover member with one end thereof bent 90 degrees. Further, a cable heater (length 1.5 m, 100V, and 30W) is integrated with one end face, thereby completing a three-layer product (150×150×200 mm, and space thickness: 50 mm).

This device was placed in an atmosphere of 90% absolute humidity, and was electrified for 30 minutes a day, whereby about 7 grams of water was obtained per day.

(Experiment −1)

Incidentally, a commercially available, disposable moisture absorber placed in a closet or the like produces about 100 ml of water per month. The moisture absorber according to the present invention produces a dehumidifying effect of a much higher level. A commercially available dehumidifier for indoor use produces 100 mg of water per hour. The above embodiment becomes comparable to this dehumidifier by increasing the size of its moisture absorbing area to 60×60 cm. The water thus produced was dried but no solid was found. This proved that the hygroscopic filler did not flow out of the moisture absorber. Thus, the performance of the moisture absorber does not deteriorate over a long time of use.

(Experiment −2)

Sheets of felt impregnated with 20% by weight of calcium chloride acting as the hygroscopic filler was stacked to produce a moisture absorber 50×50×150 mm. A cable heater (100V and 22.5W) was secured to the back surface of the moisture absorber, and a water holder was attached to the apparatus. A cable heater was applied also to the bottom of the water holder.

A moisture content sensor is mounted in the moisture absorber, and a humidity sensor was attached to a surface of the moisture absorber. When the room humidity was above 50% RH and the moisture content of the moisture absorber increased correspondingly, the moisture content sensor would detect it and turn on the cable heater of the moisture absorber. On the other hand, when the humidity fell below 0.40% RH, the humidity sensor attached to the absorber surface would detect it and turn on the heater in the water holder.

This apparatus was placed in an atmosphere of 25° C. and 80%, whereby 10 ml of water accumulated in the water holder in a day.

When the dehumidifying apparatus of the present invention was placed in an atmosphere of 25° C. and 30% with water stored in the water holder, 5 ml of the water was exhausted per day. (Specific Construction of the Moisture Absorber −2)

A laminar moisture absorber 1 was prepared by impregnating a rock fiber board (specific gravity: 0.25, average interstice diameter: 55 micrometers, and void ratio: 90.6%) having phenol resin of 50 mm thickness and 20×50 cm (1,000 $cm^2$) moisture control area as the binder, with 15% by weight of calcium chloride acting as the hygroscopic filler. Three of this moisture absorber 1 were stacked one upon another with one laminar face overlying another through 1.5 mm thick plastic plates acting as guides and reinforcements. The resulting product was placed in the casing 18 with one end thereof bent 90 degrees. Further, a cable heater 5 (length 1.5 cm, 100V, and 30W) is integrated with one end face acting as the moisture desorbing face, thereby completing a three-layer product (150×150×200 mm, and space thickness: 50 mm). This moisture absorber was placed in the humidity-insulating box 12 which was lined with vinyl chloride, and the following experiments were conducted.

(Experiment −1)

A moisture conditioning and drying test was carried out with a highly humid ambient atmosphere of 8° C. and 90% RH. Further, a comparative test was carried out on a Peltier type dehumidifier placed in the same box as the box 12 used in the Specific Construction of Moisture Absorber −1.

Figure 9:
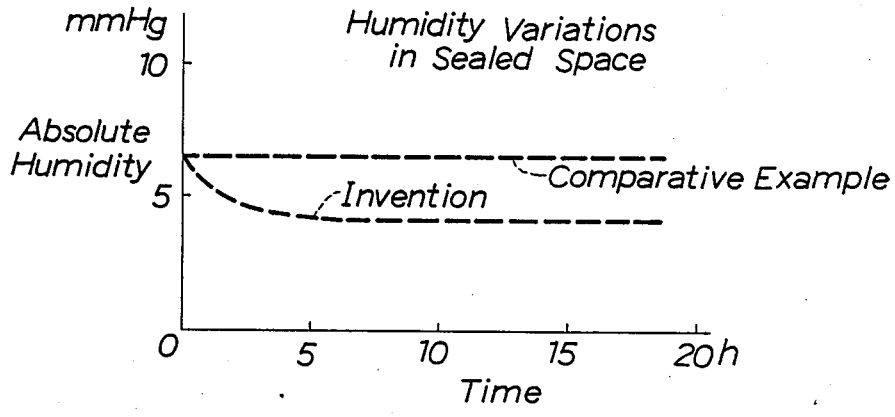

Temperature variations in an empty storeroom were measured, the results of which are shown in FIG. 9. In the case of the Peltier type dehumidifier which dehumidifies through formation of dew drops due to cooling, no temperature decrease occurred probably because its cooling section was frosted. With the apparatus according to the present invention, a marked temperature decrease occurred and an equilibrium was reached upon laps of about 150 minutes.

(Experiment −2)

Figure 10:
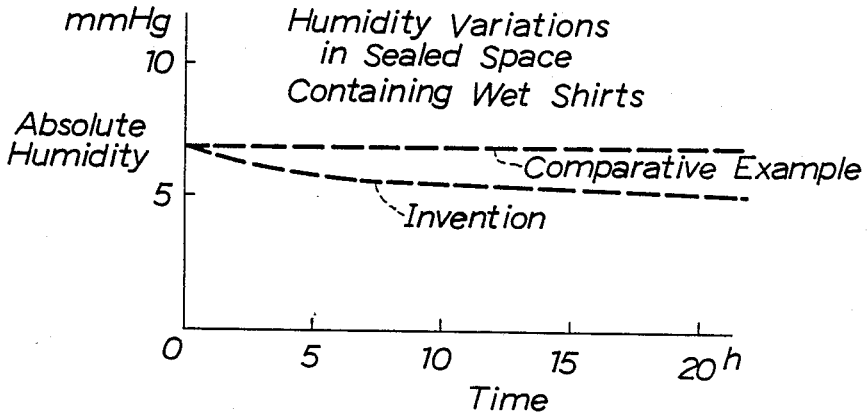

Wet shirts as set out in Table 1 were placed in the storeroom, and clothing dehumidifying tests were carried out. The box 12 used was lined with vinyl chloride as in Experiment −1. Internal temperature variations are shown in FIG. 10.

TABLE 1

| Shirts | Weight (g) | Moisture Absorption | Absorption (g) Rate (%) |
|---|---|---|---|
| Cotton −1 | 202 | 14 | 6.9 |
| Cotton −2 | 215 | 16 | 7.4 |
| Cotton & Poly −1 | 163 | 8 | 4.9 |
| Cotton & Poly −2 | 172 | 8 | 4.7 |

It has been confirmed that, with the present invention, the temperature in the storeroom fell and moisture was removed from the clothing. With the comparative example, there occurred no change in the weights of the clothing and the absolute humidity changed little.

The absolute humidity of 5 mmHg corresponds to a relative humidity of 50 to 60%. Thus, fur coats wet with snow in wintertime, for example, may be placed in the box according to the present invention for moisture control. Thus, the storeroom to which the invention is applied is well suited for storing clothing, cameras and other articles without damage for unlimited periods of time.

What is claimed is:

1. A dehumidifying apparatus comprising a moisture absorber including a porous material formed of laminated fiber having continuous fine interstices, a hygroscopic filler that fills said interstices, said moisture absorber having at least one laminar section which forms a moisture absorbing face, a heating element integrated with a moisture desorbing end face of said moisture absorber spaced from said laminar section for allowing release of moisture from the moisture absorber, a cover member overlying at least one portion of said moisture absorber, a spacing between said heating element and said cover member, and a water holder disposed below said moisture absorber that collects moisture absorbed by said moisture absorber.

2. A dehumidifying apparatus as claimed in claim 1, in which said cover member is formed by a humidity-insulated box acting as a storeroom, said humidity-insulated box including four peripheral sides forming moisture absorbing openings, said humidity-insulated box further defining a moisture release opening in a peripheral position thereof of communicating with said moisture desorbing end face of said moisture absorber.

3. A dehumidifying apparatus as claimed in claim 2, wherein said moisture absorber is formed of rock fiber bound together by a binder.

4. A dehumidifying apparatus as claimed in claim 3, wherein said hygroscopic filler comprises calcium chloride.

5. A dehumidifying apparatus as claimed in claim 4 wherein said rock fiber board has a specific gravity of about 0.25, an average interstice diameter of about 55 micrometers with a void ratio of about 90.6% and having a phenol resin-sized binder of about 200×150×5 mm, with about 15% by weight of calcium chloride which functions as said hygroscopic filler.

6. A dehumidifying apparatus comprising a moisture absorber including a porous material formed of laminated fiber having continuous fine interstices, a hygroscopic filler that fills said interstices, said moisture absorber having at least one laminar section which forms a moisture absorbing face at a right angle to a moisture desorbing face, a heating element integrated with said moisture desorbing face of said moisture absorber which allows release of moisture from the moisture absorber, and a cover which overlies at least one portion of said moisture absorber.

7. A dehumidifying apparatus as claimed in claim 6, in which said cover member overlying at least one portion of said moisture absorber defines a spacing around said heating element, and includes a water holder disposed below said moisture absorber.

8. A dehumidifying apparatus as claimed in claim 7, in which said cover member is a humidity-insulated box acting as a storeroom, said humidity-insulated box including four peripheral sides forming moisture absorbing openings, said humidity-insulated box further defining a moisture release opening in a peripheral position thereof for communicating with a moisture desorbing face of said moisture absorber.

9. A dehumidifying apparatus as claimed in claim 8, wherein said moisture absorber is formed of rock fiber bound together by a binder.

10. A dehumidifying apparatus as claimed in claim 9, wherein said hygroscopic filler comprises calcium chloride.

11. A dehumidifying apparatus as claimed in claim 10 wherein said rock fiber board has a specific gravity of about 0.25, an average interstice diameter of about 55 micrometers with a void ratio of about 90.6% and having a phenol resin-sized binder of about 200×150×5 mm, with about 15% by weight of calcium chloride which functions as said hygroscopic filler.

12. A dehumidifying apparatus as claimed in claim 5 which includes more than one moisture absorber stacked one on the other.

13. A dehumidifying apparatus as claimed in claim 11 which includes more than one moisture absorber stacked one on the other.

* * * * *